United States Patent [19]

Absmann

[11] 4,205,583

[45] Jun. 3, 1980

[54] KEYBOARD CONSTRUCTION FOR PIANOS

[75] Inventor: Horst L. Absmann, Brea, Calif.

[73] Assignee: CBS Inc., New York, N.Y.

[21] Appl. No.: 859,918

[22] Filed: Dec. 12, 1977

[51] Int. Cl.[2] ..... G10C 3/12

[52] U.S. Cl. ..... 84/433; 84/430; 84/435; 84/438; 84/439; 84/452 P

[58] Field of Search ..... 84/423, 430, 432–436, 84/438–439, 452 P

[56] References Cited

U.S. PATENT DOCUMENTS

| | | | |
|---|---|---|---|
| 371,666 | 10/1887 | Brown | 84/237 |
| 703,021 | 6/1902 | Tonnesen et al. | 84/435 |
| 1,028,753 | 6/1912 | Long | 84/434 |
| 1,155,299 | 9/1915 | Darley | 84/174 |
| 1,224,994 | 5/1917 | Anelli | 84/439 |
| 1,589,745 | 6/1926 | Federle | 84/433 |
| 1,745,265 | 1/1930 | Mecera | 84/435 |
| 2,256,856 | 12/1941 | Farny | 84/433 |
| 2,470,148 | 5/1949 | Demuth | 84/423 |
| 2,530,712 | 11/1950 | Martin | 84/433 |
| 2,584,319 | 2/1952 | Appel | 84/433 |
| 2,627,777 | 2/1953 | Robbins | 84/423 |
| 2,832,251 | 4/1958 | Hayslett | 84/433 |
| 2,844,065 | 7/1958 | Corwin | 84/423 |
| 2,911,874 | 11/1959 | Gunther | 84/439 |
| 2,999,411 | 9/1961 | Rice | 84/439 |
| 3,032,455 | 5/1962 | Fauser | 84/438 X |
| 3,087,368 | 4/1963 | Lund | 84/423 |
| 3,120,146 | 2/1964 | Stiles | 84/433 |
| 3,187,619 | 6/1965 | Andersen | 84/437 |
| 3,200,689 | 8/1965 | Rosberger | 84/423 |
| 3,205,754 | 9/1965 | Becwar | 84/433 |
| 3,248,992 | 5/1966 | Wood et al. | 84/436 |
| 3,254,554 | 6/1966 | Nordquist | 84/434 |
| 3,306,152 | 2/1967 | Klann | 84/423 |
| 3,330,176 | 7/1967 | Schwartz et al. | 84/433 |
| 3,417,649 | 12/1968 | Wood | 84/433 |
| 3,422,720 | 1/1969 | Johnson | 84/435 |
| 3,447,414 | 6/1969 | Lo Duca | 84/436 |
| 3,616,722 | 11/1971 | Hochleitner | 84/434 |
| 3,715,950 | 10/1972 | Nordquist | 84/433 |
| 3,722,351 | 3/1973 | Allen et al. | 84/423 |
| 3,745,874 | 7/1973 | Martin et al. | 84/433 |
| 3,750,522 | 8/1973 | Groves et al. | 84/423 |
| 3,774,493 | 11/1973 | Yamada | 84/423 |
| 3,855,894 | 12/1974 | Thomas et al. | 84/423 |

FOREIGN PATENT DOCUMENTS

| | | | |
|---|---|---|---|
| 968196 | 5/1975 | Canada | 84/452 P |

*Primary Examiner*—Lawrence R. Franklin
*Attorney, Agent, or Firm*—Gausewitz, Carr & Rothenberg

[57] ABSTRACT

The keyboard for pianos and similar musical instruments has key shanks (levers) formed of structural foam containing glass fibers, there being only one shank construction for all the white keys and another for all the black. The shanks are connected, at their outer ends, to self-positioning hollow key caps. Each shank rests, at a laterally thickened central portion, on a synthetic resin balance rail from which an integral balance pin projects into a slot in such central portion. The outer end of each shank rests on a synthetic resin guide rail having a guide pin formed integrally therewith and extending into the shank. The laterally thickened central portions of the shanks are sufficiently close to each other to provide a strengthening effect creating much resistance to side forces such as occur, for example, during shipment. The balance rail and guide rail, with their integral pins, are injection molded of solid synthetic resin.

22 Claims, 9 Drawing Figures

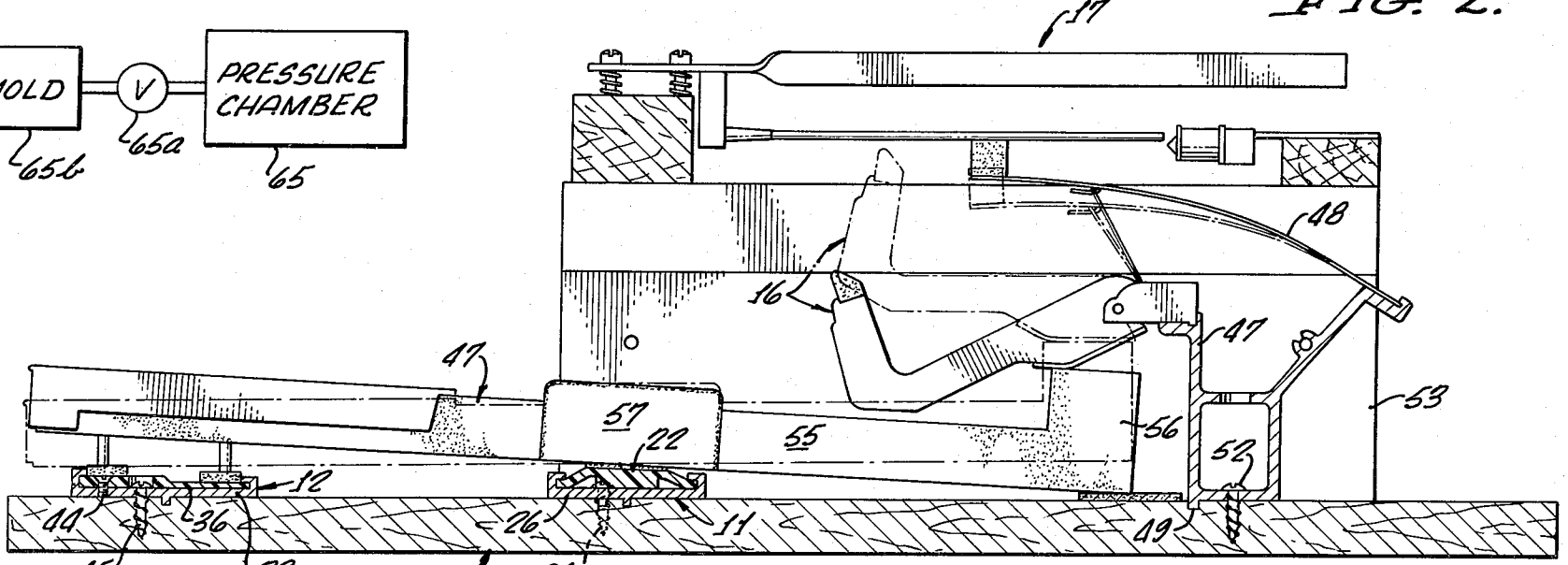
FIG. 2.
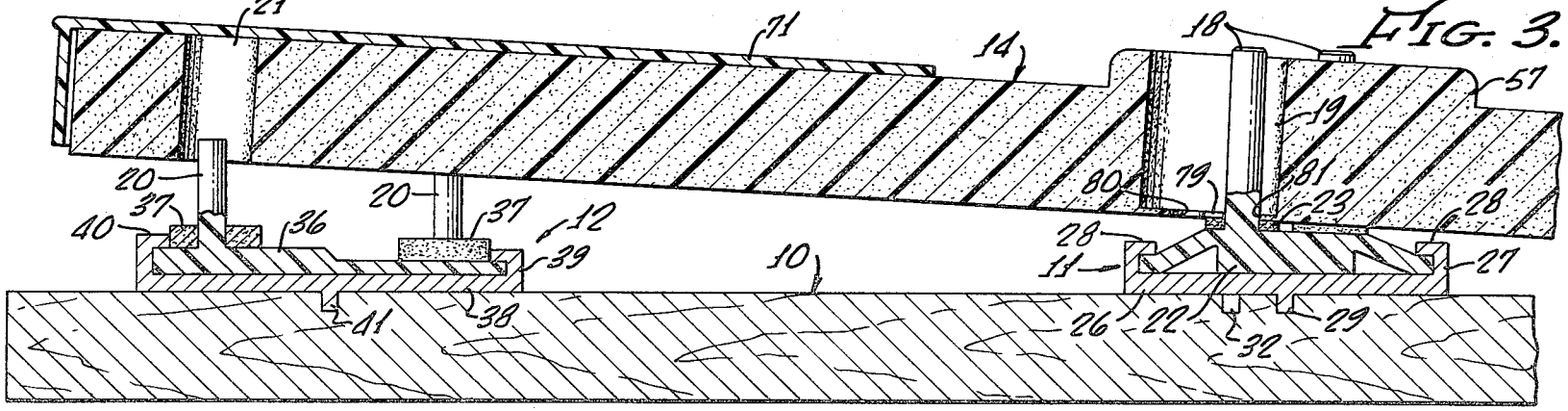
FIG. 3.
FIG. 9.

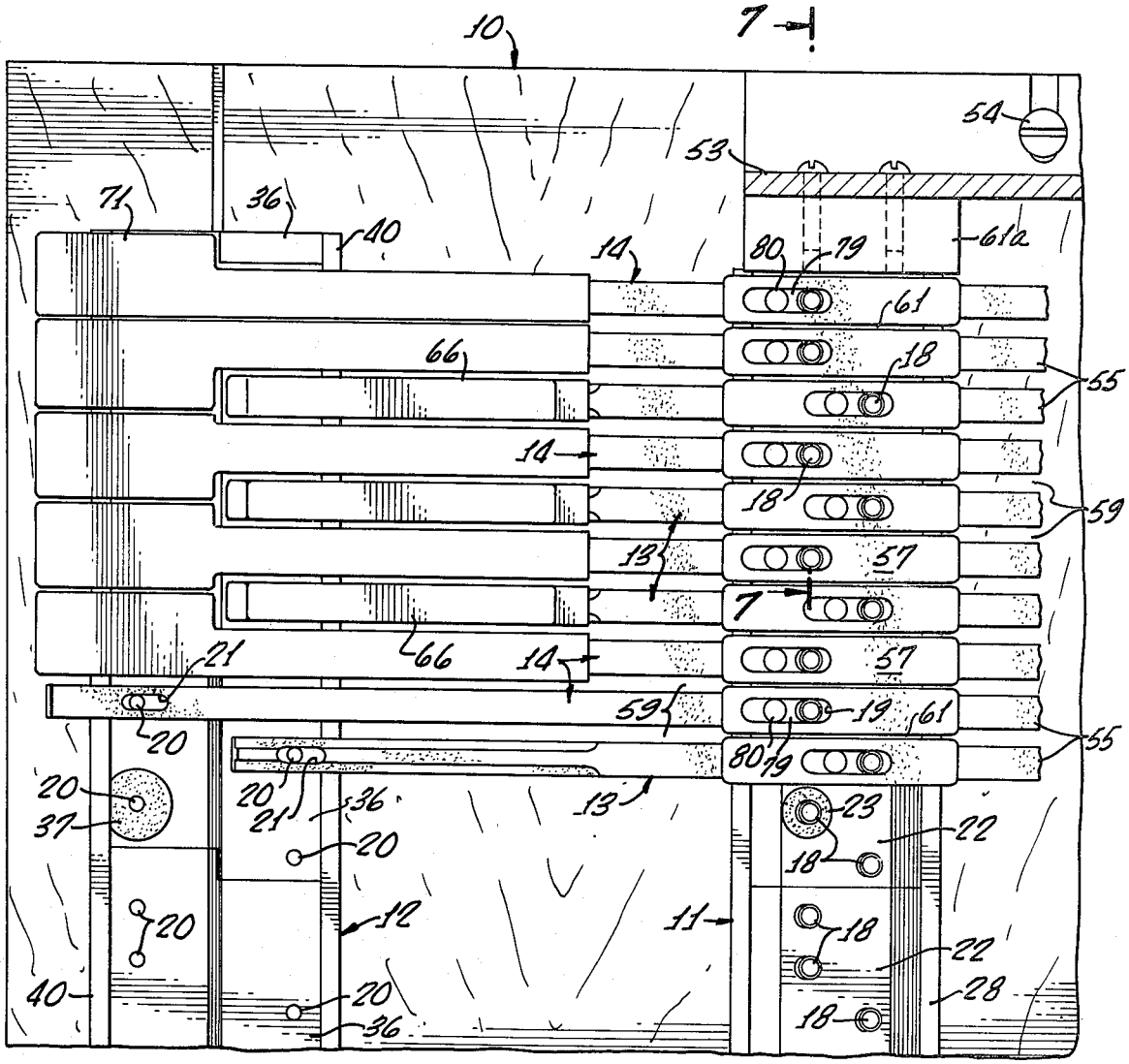
FIG. 6.
FIG. 7.
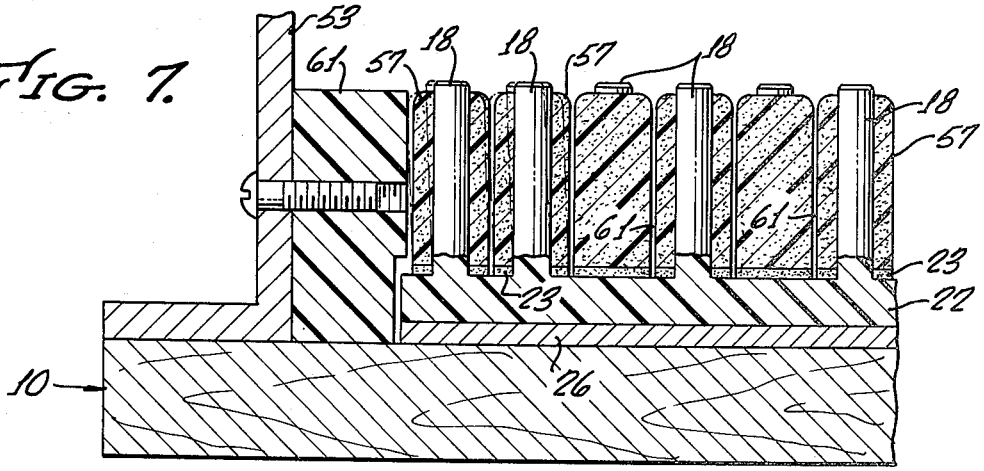

KEYBOARD CONSTRUCTION FOR PIANOS

BACKGROUND, AND DESCRIPTION OF PRIOR ART

Electromechanical "suitcase" or "stage" pianos are carried by professional pianists from job to job, with the great advantage that the exact same instrument is played each night. This means, however, that the piano must be able to withstand large shocks, both mechanical and thermal. A mechanical shock will occur, for example, when the piano is dropped. As an example of a thermal shock, let it be assumed that the pianist is carrying the piano in the trunk of his car on the desert and that the temperature within the trunk is over 200 degrees F. The pianist then parks at an airport and boards a jet plane, where the temperature in the baggage compartment is soon about minus 70 degrees F.

Not only must the piano be so constructed as to withstand the indicated shocks, but its keyboard must be able to take—without breakage or any substantial wear—millions of heavy blows such as are often imposed by rock musicians. In addition to being substantially immune to wear, it is a distinct necessity that the shanks do not tend to bounce off the balance rail as the outer portions are hammered.

A further and extremely important requirement is that the keyboard be quiet. There should be no substantial clicks, rattles, rubbing sounds, etc., so that the only thing heard by the pianist and those around him is the music. This requirement, and others stated herein, are of course applicable not only to electromechanical pianos but also to acoustic pianos and similar keyboard musical instruments in which the present keyboard may be employed.

Another major requisite of keyboards is that they be quickly mass-producible with great precision, low cost and few parts. When it is considered that there are as many as 88 keys in each instrument, the saving of even a few seconds relative to each key is a substantial item. It is of major importance that the keys be quickly and easily removable from and then replaceable in the instrument, and that there be no requirement for replacing of the key in the exact same position it previously occupied.

The keyboard should, both to the musician and to service men, have the same general mode of operation, assembly and re-assembly as has been familiar in wooden keyboards for many decades. Thus, for example, there should be pins which actually project upwardly into slotted shanks—but without the severe noise, wear, cost and other factors characteristic of keyboards with wooden shanks and metal pins. The pin-in-slot construction permits mounting and removal of the keys in seconds, without making any connections or disconnections.

To state an additional requirement—one especially applicable to suitcase electric pianos—there must be lightness. Thus, for example, the elimination of one whole sheet of strong, heavy plywood is important. Not only is weight reduced, but cost is brought down by a major factor.

Of course, it is essential that the keyboard play well—"feel" very good to the musician. He is highly interested in touch, balance, inertia, etc. With regard to touch, it is pointed out that different pianists have different requirements in that some like it light and others heavy. To achieve—at almost no added cost—a piano whose touch may be changed in a manner of minutes by a dealer, in order to satisfy a particular buyer, is an important accomplishment. Very importantly, the weight of each key must be substantially the same as that of each other key. Then, there will be the same feel or touch sensation at each and every key. Such touch should be similar to that of a wooden keyboard.

There are a large number of prior-art patents which describe piano keyboards made of synthetic resin, metal, and combinations thereof. However, to this day the piano keyboards commercially produced by all manufacturers known to applicant are primarily wood. In particular, the shanks are sawed from wood. The balance pins and guide pins are steel driven into maple, and there are numerous bushings which are laboriously inserted into the shanks. Wear is a major problem, as are cost, noise, and various others of the factors listed above.

The present keyboard is believed to be the first to solve all of the above (and other) problems, and to be the first synthetic resin piano keyboard which has high quality and is also capable of being easily and economically mass-produced.

SUMMARY OF THE INVENTION

Structural foam key shanks, containing glass fibers, are so associated with synthetic resin balance pins as to pivot quietly and in controlled manner even after being struck many millions of times. The balance pins are integral with synthetic resin balance rail components, being sufficiently large and resilient to maximize resistance to breaking. The danger of breakage is further greatly reduced by laterally thickening the shanks at regions adjacent the balance pins. The thickened portions are so close to corresponding portions of adjacent shanks that a "domino" (reverse domino-effect) strengthening action is achieved. The thickened portions further permit the balance pins to be large in diameter, even though the remaining portions of the shanks are relatively narrow so as to be closer to the weight and inertia of wooden keys. The shanks are slotted to receive the balance pins, and also to receive synthetic resin guide pins which are integral with guide rails.

No bushings are required or desired in the slots. The structural foam has a smooth, hard skin which cooperates surprisingly with the synthetic resin pins relative to the crucial wear and noise factors. The structural foam is relatively heavy, having a density above 20 pounds per cubic foot and preferably above 25 pounds per cubic foot. Such density is largely compensated for by providing the thin shank bodies having the above-mentioned laterally thickened portions. Excess weight of the key shanks and caps is more than overbalanced by reduced weight of the underlying support structure indicated below.

The balance rail components and corresponding guide rail components, each having numerous integral pins, are slid into aluminum extrusions in a subassembly operation. The lengths of such extrusions vary in accordance with the number of piano keys. The indicated subassemblies are then keyed to grooves in the bottom wall of a "suitcase" or other piano, following which they are secured in place by fastener means. Not only does this create a very rapid assembly operation, but the resulting keyboard is strong and light. The extrusions, with contained synthetic resin rail components, cooperate with extruded aluminum side rails and action (pivot)

rails to strengthen and keep flat and rigid the indicated bottom wall.

Each of the thickened shank portions has two spaced holes adapted to receive a balance pin in snug relationship, the pin extending upwardly into a close-tolerance slot. There are two grooves in the bottom wall for each balance-rail extrusion. The spacing between the two holes is equal to that between the two grooves. Accordingly, "touch" may be adjusted by quickly removing the keys, shifting the extrusion to the remaining groove, and then replacing the keys but with the balance pins extending through the holes not previously used. The positions of the shanks do not change at all. The cost of this "touch adjustment" capability is almost nothing.

BRIEF DESCRIPTION OF THE DRAWINGS

FIG. 2 is a vertical sectional view on line 2—2 of FIG. 1, and also showing a tone generator mounted above a hammer;

FIG. 3 is an enlarged vertical sectional view illustrating one of the white keys and the underlying balance and the guide-rail means;

FIG. 6 is a plan view of the outer and intermediate portions of the keyboard;

FIG. 7 is an enlarged transverse sectional view on line 7—7 of FIG. 6;

FIG. 9 is a block diagram of the mold means.

DETAILED DESCRIPTION OF THE PREFERRED EMBODIMENT

Figure 1:
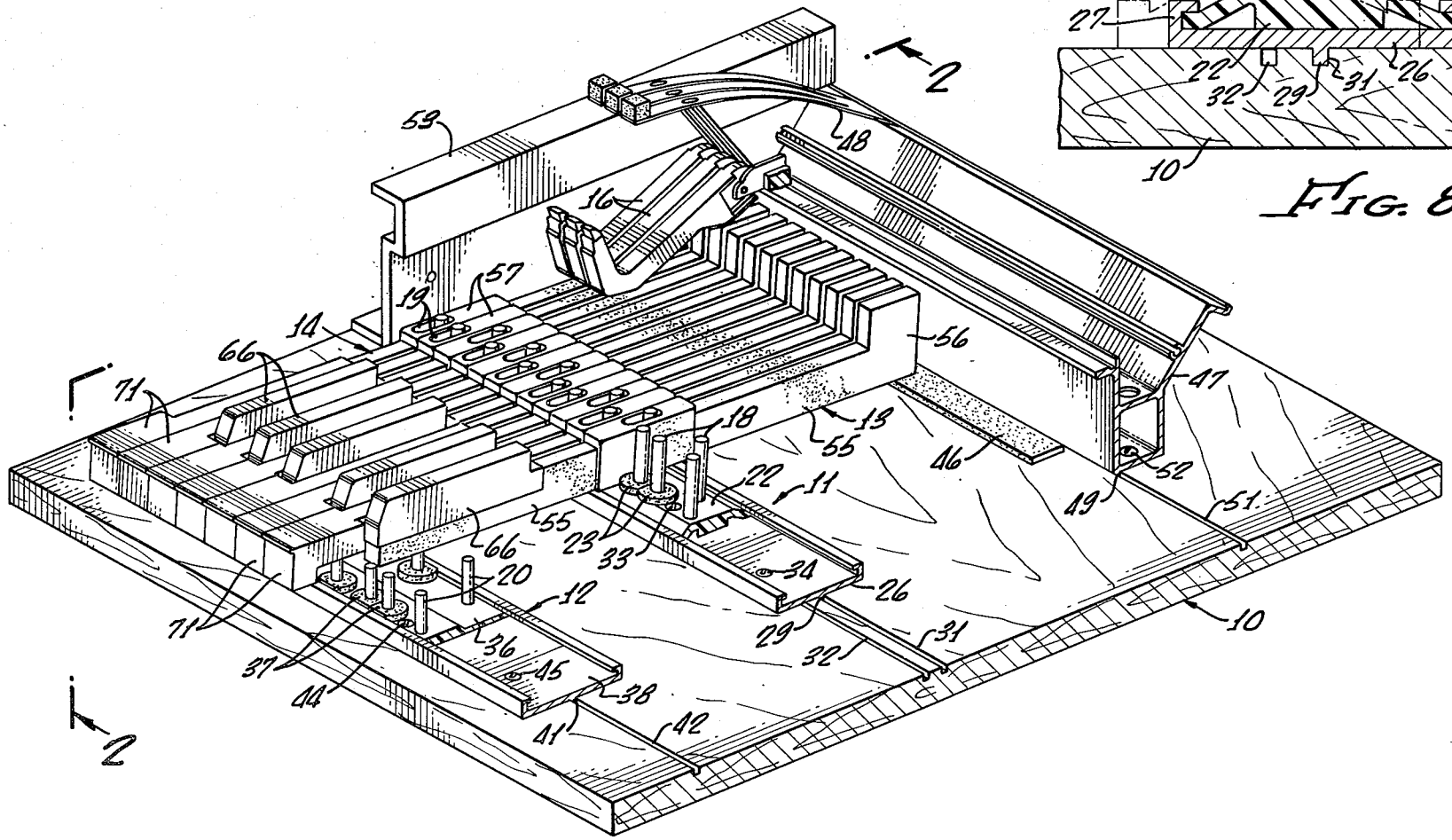
FIG. 1 is an isometric view showing a section of the present keyboard.

Referring first to FIG. 1, the number 10 indicates the bottom wall of a cabinet or housing containing the piano keyboard and associated piano action. There may be a full-size cabinet, as is used in the home, or the wall 10 may be the bottom wall of a "suitcase" electromechanical piano—for example of the type shown in U.S. Pat. Nos. 2,972,922 and 3,285,116, inventor Harold B. Rhodes. Said patents are hereby incorporated by reference herein. Wall 10 is preferably plywood.

A balance rail assembly 11 and guide rail assembly 12 are mounted on wall 10 for pivotal support and guiding of piano key shanks (key levers) 13 of the black keys and 14 of the white. The shanks are adapted to actuate portions of the actions of electromechanical pianos or acoustic pianos. In the illustrated construction, the shanks operate hammers 16 to make them strike the tone generators 17 (FIG. 2) of an electromechanical piano having vibrating tines which are associated with mechanical-electrical transducers. Reference is made to U.S. Pat. Nos. 3,270,608 and 3,384,699, inventor Harold B. Rhodes, and to U.S. Pat. No. 3,644,656, inventors Clarence L. Fender and said Rhodes, all of which are hereby incorporated by reference herein.

The balance rail assembly 11 includes synthetic resin pins 18 which extend through holes into longitudinal slots 19 in shanks 13 and 14. Guide rail assembly 12 includes pins 20 extending into longitudinal slots 21 in such shanks. Because of the particular materials, sizes, tolerances, and other factors set forth in detail below, there need be no bushings within the slots 19 and 21 yet the action is extremely quiet and free of slop and play, even after many millions of forceful blows.

Proceeding to a detailed description of the balance rail assembly 11, this comprises a plurality of discrete, axially-adjacent elongated rail elements 22 which are in endwise abutment (FIG. 6). The rail elements 22 and the balance pins 18 are integral with each other, being simultaneously injection-molded of synthetic resin. Mounted around each pin 18 and supported on rail 22 is a felt washer 23 which supports in noise-free manner the central region of an associated shank (key lever) 13 or 14.

The various rail elements 22 are mounted in an aluminum extrusion (strengthening rail) 26 which extends continuously for the full length of the keyboard. As best shown in FIG. 3, extrusion 26 is generally channel-shaped, having side walls 27 which are integral at their upper edges with inwardly-extending retainer flanges 28. Such flanges seat above edge portions of the rail elements 22. In the illustrated embodiment, the synthetic-resin rail edge portions incline downwardly from a solid central portion of each rail.

The web of the channel-shaped extrusion 26 seats on the upper surface of wall 10 and has a downwardly-extending flange or key 29 adapted to seat selectively in one of two parallel milled grooves 31 and 32 in such wall. To hold all of the parts in their illustrated positions, the rail elements 22 are secured by metal screws 33 (FIG. 1) to the extrusion only, whereas the extrusion itself is mounted directly and securely to wall 10 by means of wood screws 34. Wood screws 34 do not seat on the rail elements but instead have their heads disposed in oversize openings therein.

The guide rail assembly 12 also comprises a number of discrete, injection-molded synthetic resin guide rail elements 36 which are integral with guide pins 20. Each pin 20 has a felt washer 37 mounted therearound to form a secondary stop for the associated shank (the primary stop being provided by the butt portions of hammers 16 as described in U.S. Pat. No. 3,270,608). An aluminum extrusion 38, which is similar to the above-described extrusion 26 in that it has side walls 39 and inwardly-extending flanges 40, is mounted on wall 10 at a predetermined position determined by a bottom flange 41 and associated milled groove 42 (FIG. 1). Similarly to the case of the balance rail assembly, the rail elements 36 are held down by metal screws 44 (shown at the left side of FIG. 2) whereas the extrusion is anchored by wood screws 45 the heads of which do not seat on the rails but instead directly on the web of the extrusion.

The balance pins 18 for shanks 13 of the black keys are staggered relative to those for the white-key shanks 14. Correspondingly, the guide pins 20 for the black-key shanks are staggered relative to those for the white-key shanks. In all cases, the pins for the black keys are disposed inwardly of those for the white. Furthermore, the outer ends of the black-key shanks are above lower portions of rails 36 than are the corresponding portions of the white-key shanks. Thus, and as shown in FIG. 3 in particular, rails 36 have two levels, there being a thick outer portion disposed beneath the white key ends and a thin lower portion beneath the black.

In addition to the described felt washers, there is mounted on wall 10 (as shown in FIG. 1) a felt strip 46 adapted to cushion in noise-free manner the downward movement of the inner ends of the shanks. It is emphasized that all felts in the present piano action are employed in compression only, which is a substantially noise-free relationship. There need not be, and preferably is not, any felt disposed in any slot. Thus, no felt is in a rubbing relationship. The latter types of felts are expensive to use, are subject to wear and disintegration, and actually create noise during the rubbing.

It is a feature of the present construction that the extruded metal channels 26 and 38 are strong and, in cooperation with other extrusions next to be mentioned, provide bracing and structural-supporting relationships preventing warpage and distortion of wall 10. Thus, it becomes practical to use only the wall 10, which is an outer wall of the suitcase piano or the bottom wall of the cabinet portion of a home piano, instead of providing a separate frame as has been used in prior constructions sold by the assignee of applicant.

Channels 26 and 38 cooperate with a very strong and rigid pivot rail 47 which provides pivotal support for all of the hammers 16. It further supports numerous damper springs 48 (FIG. 1). The pivot rail is constructed with a depending flange 49 which is positioned in a groove 51 (FIG. 1) in wall 10. The rail is secured in place by fasteners 52 which may be screws or bolts.

An additional extrusion 53 (FIG. 6) is provided at each end of wall 10, in perpendicular relationship to the described extrusions 26, 38 and 47. These extrusions 53, only one of which is shown although it is to be understood that another and identical one is present at the other end of the keyboard, provide support for the harp comprising tone generators 17 (FIG. 2) and associated transducers and supporting structure. Furthermore, the end extrusions effect additional bracing preventing warpage of wall 10. The end extrusions are angle-sectioned and are secured in place by bolts or other suitable fasteners as shown at 54 in FIG. 6.

Figure 4:
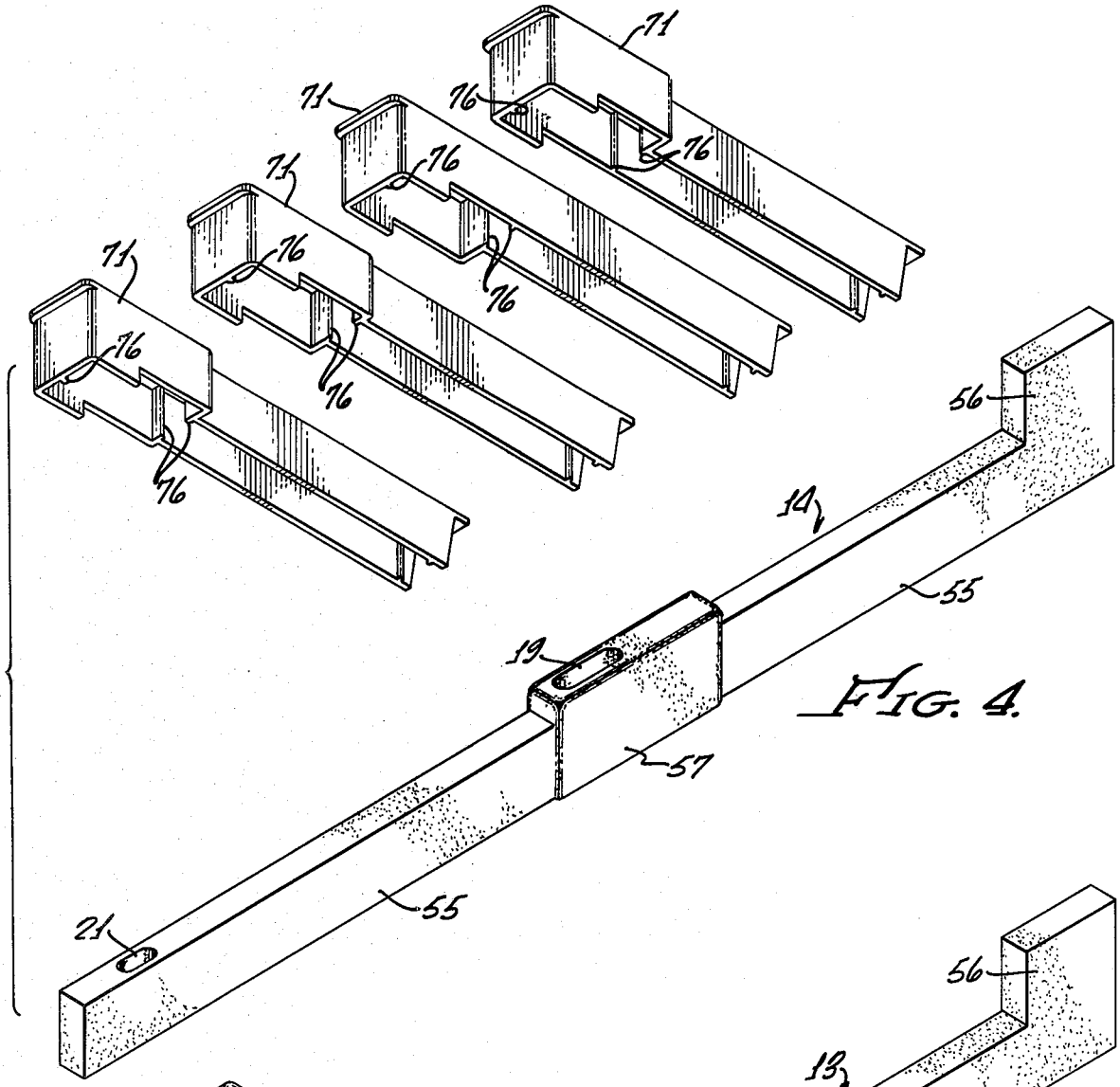
FIG. 4 is an isometric view showing one of the shanks or levers of the white keys, and also showing in exploded form several white key caps adapted to be mounted on such shank.
Figure 5:
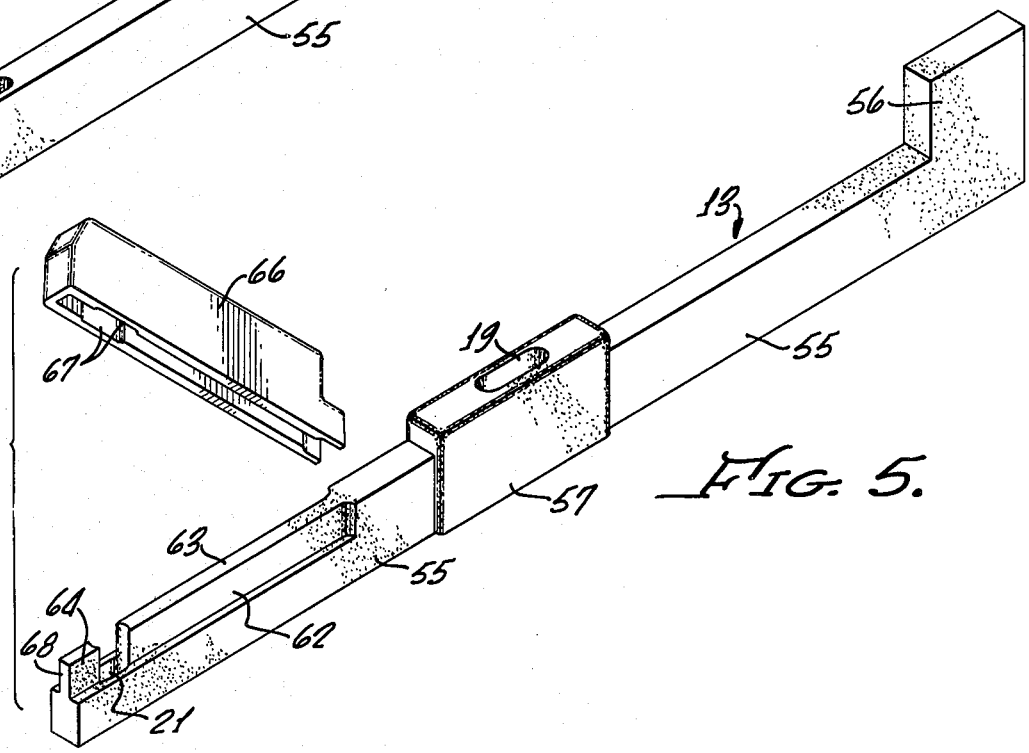
FIG. 5 is a view corresponding to FIG. 4 but illustrating an associated black key shank and black key cap.

Proceeding next to a description of the shanks (key levers) 13 and 14, these are best shown in FIGS. 4 and 5. Each has an elongated body 55 which is rectangular in section, the sectional shape being vertically elongated. At the inner end of each body 55 is an upwardly-extending actuating portion 56 which operates the piano action for each key. In the type of action shown in FIG. 2, and as previously indicated, portion 56 engages and operates the butt portion of one of the pivotally-mounted hammers 16.

At its central region, above balance rail assembly 11, each shank has a laterally-thickened portion 57. Furthermore, portion 57 extends upwardly (above the level of the adjacent horizontal upper surfaces of the shank) to form an upward extension of portion 57. As best shown in FIG. 6, body portions 55 of the various shanks are narrow as viewed from above, so that large gaps 59 are formed therebetween both inwardly and outwardly of the laterally thickened portions 57. However, portions 57 are sufficiently wide (thick) that the gaps 61 therebetween (FIG. 6) are narrow, being only sufficiently wide to assure that there is no possibility of rubbing contact between the opposed surfaces of adjacent portions 57.

It is an important aspect of the present invention that the shanks 13 and 14 are individually molded of structural foam, that is to say partially-foamed synthetic resin which has been allowed to cool in a mold shaped to define a cavity corresponding to a shank 13 or 14. The amount of such foaming is relatively small, so that the resulting foamed product preferably has a density greater than that of the wood (sugar pine or bass) conventionally employed to form wooden key shanks. The synthetic resin contains short glass fibers which increase greatly the dimensional stability and strength of the shanks.

The synthetic resin, containing glass fibers, is prefoamed so as to be under heat and pressure in a pressure chamber shown in block form at 65 in FIG. 9. Then, a valve 65*a* is opened so that the hot, pressurized foam rushes into the mold cavities (indicated at 65*b*), further expansion then occurring. Chamber 65 preferably contains a piston which increases the pressure. Cooling then takes place (in the mold), and a substantial skin (typically about 0.030 inch to about 0.050 inch thick) forms on the shank.

The skin is present at the walls of slots 19 and 21, since such slots are formed during the molding process. Thus, the slot walls (and all outer portions of the shanks) are smooth, non-porous and relatively hard. The surface hardness of a foamed shank is above 100 Durometer (A scale).

Because the bodies 55 are relatively narrow throughout the majorities of their lengths, having the large gaps 59 therebetween, the weights of the shanks 13 and 14 can be made more close to the weights of conventional wooden keys in order that the inertial effects will be similar. Each shank and associated cap should not weigh more than fifty percent above the weight of each key in a conventional wooden keyboard.

The density of the structural foam used in the present keyboard is higher than 20 pounds per cubic foot, and is preferably much higher (such as, above 25 pounds per cubic foot). The basswood and sugar pine used in conventional wooden keyboards has a density of about 20–25 pounds per cubic foot. Because of the relationships discussed above, applicant can use foam having a density greater than even 30 pounds per cubic foot, and still achieve keys which are not excessively heavy.

The synthetic resins preferred for construction of the present shanks are partially-foamed nylon, polypropylene, or ABS (acrylonitrile-butadiene-styrene). The glass fibers comprise about 10 to 15 percent by weight, being preferably about ¼ inch long.

Because of the presence of the laterally thickened shank portions 57, and the resulting narrow gaps 61 therebetween, adjacent shanks cooperate with each other to create a strengthening action preventing excessive bending or breakage of the balance pins 18 when the piano is dropped or otherwise abused. This may be termed a "domino" strengthening effect, although it is actually the reverse of a domino effect in that the adjacent elements support each other instead of being toppled over.

Referring to FIG. 7, let it be assumed that the shank of the key next-adjacent the lowest-pitched key of the piano is bent to the left until its portion 57 engages the adjacent portion 57. As soon as the flexing of the associated pin 18 is sufficient that the adjacent portion 57 is touched, both of the pins 18 (shown at the left in FIG. 7) become operative to resist further bending. In the event that the stress is extreme, the left-most pin 18 in FIG. 7 also bends until its portion 57 engages a stop block 61 which is bolted to extrusion 53. The upward extensions of portions 57 aid in this domino effect in that touching occurs with less bending.

The pins 18 are resilient instead of rigid, and have large diameters for reasons of wear resistance, sound deadening and high strength. These and other important factors will be discussed in detail under the next subheading.

At the outer end of each shank 13 and 14 is an associated key cap, the caps being constructed for rapid, self-positioning assembly and high strength. Referring first to the black-key shank 13 as shown in FIG. 5, the outer end of body 55 is provided with side indentations or recesses 62 generally corresponding in thickness to the widths of the opposed parallel walls of guide-pin slot 21. Thus, since slot 21 extends for the full height of the shank, there are narrow shank portions 63 and 64 located inwardly and outwardly of the slot. A hollow black key cap is shown at 66, being shaped interiorly to fit snugly over the narrow portions 63 and 64 and, furthermore, to close the sides of the slot at its upper portions.

As shown at 67 in FIG. 5, the interior of key cap 66 is made relatively wide at slot 21 in order to insure that there will be no interference with guide pin 20. With the described construction, the entire black-key assembly is formed by first molding the shank or key lever 13, then providing suitable adhesive at the forward end of the shank, and then positioning the key cap 66 in such place that the interior wall of the outer end thereof abuts against a vertical stop surface 68 of narrow portion 64.

Referring next to FIG. 4, the outer or forward end of each white-key shank 14 need not be specially shaped but instead is rectangular as shown. Each such forward end is adapted to receive the appropriate one of various white-key caps 71. These and other white-key caps (not shown) are hollow, and each has inner ribs or projections 76 at appropriate points which automatically effect perfect positioning of the key cap on the shank 14 during the gluing operation. The internal ribs 76 effect such positioning despite the fact that the body 55 of the shank is relatively narrow.

The resulting black-key and white-key combinations are very strong, as required by the demands of rock and other musicians. One reason for the strength is that each shank extends clear to the forward end of the associated key cap, so that strength is derived from the guide pin 20 which extends through the slot 21.

DESCRIPTION OF FURTHER MAJOR FACTORS RELATING TO DECREASED KEY NOISE, INCREASED LIFE, ETC.

The present piano keyboard has (as above mentioned) the great advantages of excellent and uniform touch, simplicity and economy of manufacture, low noise, high strength, very long life, etc. All of these (and other) advantages are achieved without requiring such elements as springs, bent-metal fingers, and other things to which musicians and piano tuners are unaccustomed. Thus, for example, a conventional wooden piano action has balance pins and guide pins and is so constructed that any key may be removed when desired by merely removing the cover and rail and then lifting the key off the pins. These same advantages are achieved with the present keyboard. Furthermore, in the present keyboard the operator never has to number all the keys and put every one back in the exact same place it occupied before. Instead, as above noted, all black keys are interchangeable, and all white keys having the same-shaped key caps are interchangeable.

In conventional piano keyboards, the balance pins and guide pins are metal pins mounted in maple wood. Typically, each such metal balance pin might have a diameter on the order of 0.125 inch whereas each guide pin would (typically) be oblong in horizontal section. For example, the oblong horizontal section of the guide pin may be 0.130 inch at its shortest dimension and 0.210 inch at its longest. The guide pins are oblong in section, as stated, so that they may be turned in order to compensate for the effects of wear, the longer dimension then being made more and more transverse to the axis of the key as wear increases. Conventionally, each pin is within a sleeve or bushing laboriously glued into the wooden key shank.

In the present keyboard, the balance pins 18 are large-diameter cylinders each preferably having a diameter of about 0.250 inch. In other words, these cylinders are preferably one-quarter inch in diameter. The guide pins 20 preferably have a diameter of about 0.187 inch, which is about 90 percent of the maximum diameter of the oblong prior-art guide pin mentioned above. The present guide pins 20 are cylindrical and need never be rotated, being (as are the balance pins 18) integral with the rails therebeneath.

The guide pins and balance pins are shiny and smooth, and are preferably formed of commerically-available ABS synthetic resin (acrylonitrile-butadiene-styrene). It is not necessary to use expensive plastics such as Delrin. The pins are—particularly because of their large diameters—strong. They are resilient instead of brittle, for increased shock resistance and decreased noise. The above-described reverse domino-effect prevents any adverse consequences from resulting from such resilience.

It is important that the pins be fitted closely within their associated bushing-free slots 19 and 21. Large tolerances may produce rattling or clicking noises, even though these are reduced because the shanks are formed of structural foam instead of solid plastic or wood.

The spacing on each side of each pin, between it and the adjacent side wall of a slot 19 or 21, is only a few thousandths of an inch. Thus, the width of balance-pin slot 19 may be 0.260 inch in the present example (where pin 18 is 0.250 inch in diameter), whereas the guide slot width 21 may be 0.192 inch in the present example (where pin 20 is 0.187 inch in diameter). Slots 19 and 21 are sufficiently long that the pins never engage their ends. There are important close-tolerance holes, described below, in the bottom walls of slots 19.

With the described construction, the synthetic-resin balance rail elements 22 and guide rail elements 36 are slid into the extrusions 26 and 38 prior to mounting of the latter on wall 10. The metal screws 33 and 44 (FIG. 1) are employed to hold the rails and their associated pins in place, and felt washers 23 and 37 are merely dropped over the pins. The extrusions are then mounted on wall 10, in their respective slots. It is then merely necessary to drop the various black-key shanks and white-key shanks over their pins, without making any connections whatever. There is no necessity for extensive correlating of the shanks to each other since, for example, the shanks for all of the "C" keys on the piano can come out of the same bin.

To complete the assembly, the extrusion 47 having all of the hammers 16 and damper springs 48 preassembled thereto is mounted in groove 51 and secured down by fasteners 52. The end extrusions 53 are mounted in position, and the harp containing all of the tone generators 17 (FIG. 2) is mounted in place.

Keys constructed in accordance with the present invention have been hammered millions of times, without resulting in appreciable wear, noise, etc. The quietness of the action is surprising, and the touch and feel are excellent and similar to that of a wooden action despite the fact that the density of the structural foam is, as stated, greater than that of wood conventionally employed.

The action has, as one of its advantages, the fact that the keys do not tend to shift upwardly off the balance-rail washers 23 even when forcefully and rapidly struck by the musician. There is, therefore, no need to provide anything (such as, for example, a close-fitted keeper rail) to hold the shanks downwardly on the washers. This lack of tendency for the shanks to shift upwardly relative to the balance rails is to be contrasted with certain prior-art constructions in which the undersides of the shanks are notched and provided over hard fulcrum edges.

ASSEMBLY TO ACHIEVE DIFFERENT DEGREES OF TOUCH

In a typical situation, a particular piano is used primarily by a single musician. This is true not only in pianos for professionals but in the home—where use of a piano extensively by more than one occupant is the exception rather than the rule. Such one musician normally has a strong preference concerning whether the keyboard should have a light touch or a relatively heavy touch. The present keyboard permits the touch to be adjusted for such musician by the piano dealer, or even in the home, without difficulty and without any material increase in cost of production. The only increase in cost is that of providing the extra groove 32 shown in FIGS. 1 and 8.

The present drawings show the piano as assembled for a light touch. The touch is light, even though the shanks weigh more than wooden ones, because the forward portions of the key lever arms are relatively long. Thus, the flange 29 of extrusion 26 is disposed in the rear-most milled groove 31 so that the lever arm projecting forwardly toward the musician is long.

Figure 8:
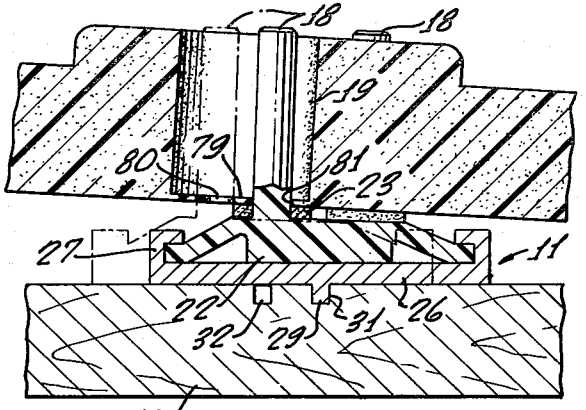
FIG. 8 is a fragmentary longitudinal sectional view showing the apparatus whereby the keyboard may be adjusted for either light or relatively heavy touch.

Referring particularly to FIG. 8, each slot 19 for balance pin 18 is distinctly elongated in the direction of the length of the key, the elongation being sufficient that the pin 18 will not strike the end of the slot at any time regardless of setting or operation. The bottom of slot 19 has a wall 79 which is horizontal and flush with the underside of the shank. Such wall is preferably very thin, for prevention of binding even though the hole tolerances are small. There are two circular holes 80 and 81 in wall 79, each hole being barely large enough to receive the pin 18 without resulting in any binding. Thus, in the present example wherein the pin is stated to be 0.250 inch in diameter, each hole 80 and 81 has a diameter of 0.255 inch.

The holes 80 and 81 are spaced from each other, longitudinally of the key, sufficiently to produce a markedly different touch. In the present example, when the pin 18 is shifted from one hole to the other, the touch is changed by a large percentage even though the spacing between the holes is (for example) only $\frac{3}{8}$ inch.

The two grooves 31 and 32 are spaced from each other by the same distance as that between the holes, namely $\frac{3}{8}$ inch in the example. Furthermore, the grooves 31, 32 are so located as to create an offsetting relationship relative to the holes 80, 81, so that regardless of which groove 31 or 32 the flange 29 is in there is always a hole 80 or 81 so positioned that the shank of each white key or each black key will be in the exact same position shown in all of the drawings.

Let it be assumed, for example, that the instrument has been constructed as shown and is present in a dealer's showroom. Then, if a particular customer states that he would like a heavier touch, the dealer can achieve such touch in a matter of minutes. This is done by removing the cover and rail (not shown) of the action and keyboard, and then lifting all of the keys off their associated balance and guide rails and disposing the keys in any convenient location. As stated, it is not necessary to keep the keys in order. Then, only the relatively few wood screws 34 are removed, and the extrusion 26 is lifted and shifted forwardly until its flange 29 (FIG. 8) is not in groove 31 but instead in groove 32. In other words, the extrusion is shifted to the position shown in phantom lines in FIG. 8. Then, all of the keys are quickly placed back on their rails, but with the pins 18 extending through holes 80 instead of holes 81. It is then merely necessary to mount the cover over the keys and demonstrate to the customer that the touch has been rendered substantially more heavy.

The upward extensions of laterally thickened portions 57 cooperate with the large pins 18 to achieve increased bearing area and thus decreased wear.

Pins 18 and 20 are preferably cylindrical, as stated, the word "cylndrical" being employed in its conventional sense to denote a right circular cylinder.

The described keyboard has been found to have excellent resistance to all temperatures to which it could be subjected—even including those in car trunks, jet aircraft luggage compartments, etc. It is also resistant to the thermal shocks resulting from extreme rapid temperature changes.

It is now preferred that the outer ends of the black-key shanks be shaped identically to the outer ends of the white (the latter being shown in FIG. 4). The hollow caps for the black keys are then provided at their lower edges with thin wall portions which straddle the upper edges of the shanks.

The keyboard has, as indicated, the major advantage that great numbers of shanks and key caps may be mass-produced and then stored in bins for use as necessary. Each shank-key combination has generally the same weight as each other. The problems involved in manufacture, storage and repair are vastly reduced—particularly in comparison to conventional wooden keyboards.

The foregoing detailed description is to be clearly understood as given by way of illustration and example only, the spirit and scope of this invention being limited solely by the appended claims.

I claim:

1. A keyboard for pianos and similar keyboard instruments wherein "touch" is of major importance, which comprises:

(a) a multiplicity of elongated structural-foam shanks, each of said shanks having been formed individually by molding, in a mold cavity, a partially-formed synthetic resin having a density in excess of 20 pounds per cubic foot, (b) guide means and pivot means to mount said shanks in parallel relationship for limited pivotal motion in vertical planes, (c) white key caps formed of synthetic resin and mounted over the outer ends of the shanks for the white keys, and (d) black key caps formed of synthetic resin and mounted over the outer ends of the shanks for the black keys.

2. The invention as claimed in claim 1, in which the skin of said structural foam has a hardness in excess of 100 Durometer (A Scale).

3. The invention as claimed in claim 1, in which said synthetic resin forming said structural-foam shanks is selected from a group consisting of nylon, ABS and polypropylene.

4. The invention as claimed in claim 1, in which said structural foam includes a minor amount of glass fibers.

5. The invention as claimed in claim 1, in which a portion of a piano action is mounted above the inner end portion of each of said shanks for operation thereby.

6. A keyboard for pianos and similar keyboard instruments wherein "touch" is of major importance, which comprises:

(a) a multiplicity of elongated structural-foam key shanks each formed by molding a partially-foamed synthetic resin in a mold cavity,
each such shank having a longitudinal slot in an intermediate portion thereof, (b) a molded balance rail formed of synthetic resin and mounted under intermediate portions of said shanks,
said balance rail having connected integrally therewith a multiplicity of synthetic resin balance pins,
each such balance pin extending upwardly into the one of said slots in the associated shank, (c) white key caps formed of synthetic resin and mounted over the outer ends of the shanks for the white keys, and (d) black key caps formed of synthetic resin and mounted over the outer ends of the shanks for the black keys.

7. The invention as claimed in claim 6, in which each such slot has a thin bottom wall which is apertured to receive one of said pins in close-fitting but pivotal relationship.

8. The invention as claimed in claim 6, in which said pin is smooth and has a large diameter, and in which said slot has parallel side walls disposed closely adjacent, but not in interfering contact with, diametrically-opposite sides of said pin, said side walls being formed of the skin of the structural foam and being smooth and hard.

9. The invention as claimed in claim 6, in which a molded guide rail formed of synthetic resin is mounted under the outer end portions of said shanks, said guide rail having connected integrally therewith a multiplicity of guide pins, each guide pin extending upwardly into an opening in the shank thereabove.

10. The invention as claimed in claim 6, in which a cushion is mounted on said rail below each shank for compressive nonrubbing loading during pivoting of said shank.

11. The invention as claimed in claim 10, in which said cushion is a felt washer mounted around each of said balance pins.

12. The invention as claimed in claim 6, in which said synthetic resin forming said structural foam is selected from a group consisting of nylon, ABS and polypropylene, and in which said synthetic resin forming said rail and pins is ABS.

13. The invention as claimed in claim 6, in which said pins are cylindrical, smooth and unjointed, have diameters of about one-quarter inch, and are sufficiently resilient to bend substantially without breaking, and in which each slot has smooth parallel side walls formed of the skin of said structural foam and located within a few thousandths of an inch of diametrically opposite sides of the pin therein.

14. The invention as claimed in claim 6, in which there is no bushing in said slot, and in which each such balance pin extends into the associated slot in close-fitting but free-moving relationship.

15. The invention as claimed in claim 6, in which a portion of a piano action is mounted above the inner end portion of each of said shanks for operation thereby.

16. A synthetic resin keyboard for pianos and similar keyboard instruments wherein "touch" is of major importance, comprising:

(a) a multiplicity of elongated structural-foam key shanks formed of synthetic resin,
each of said shanks having been formed individually by molding, in a mold cavity, a partially-foamed synthetic resin, each of said shanks having a slot therein for a balance pin, and (b) a synthetic resin balance rail mounted below intermediate portions of said shanks, and having integrally-molded unjointed synthetic resin balance pins extending upwardly therefrom into said slots,
said synthetic resin forming said balance rail and pins, and the diameters of said pins, being such that said pins are resilient,
said shanks, in the regions thereof adjacent said balance pins, being sufficiently close together to create a domino-like strengthening effect preventing said shanks from tilting laterally until the resilient pins therein break.

17. The invention as claimed in claim 16, in which said shanks are molded of structural foam having a density above 25 pounds per cubic foot, in which the bodies of said shanks are narrow so that there are large gaps between adjacent shanks, and in which said shanks have laterally thickened portions adjacent said balance-pin slots adapted to create said domino effect and to strengthen said shank thereat to permit said openings to be large.

18. The invention as claimed in claim 17, in which said laterally thickened portions extend upwardly substantially above the bodies of said shanks.

19. The invention as claimed in claim 17, in which hollow white key caps and black caps formed of synthetic resin are mounted on the outer ends of said shanks, said white key caps having internal centering protuberances creating a perfect fit and location on the outer end of the narrow shank body.

20. The invention as claimed in claim 16, in which a portion of a piano action is mounted above the inner end portion of each of said shanks for operation thereby.

21. A synthetic-resin keyboard for pianos and similar keyboard instruments wherein "touch" is of major importance, which comprises:

(a) a support member, (b) a synthetic-resin balance rail mounted on said support member,
said balance rail being injection molded and having injection-molded balance pins extending upwardly therefrom in integral relationship therewith, (c) a synthetic-resin guide rail mounted on said support member outwardly of said balance rail,
said guide rail having injection-molded guide pins extending upwardly therefrom in integral relationship therewith, (d) a first set of corresponding structural-foam shanks formed in mold cavities of partially-foamed synthetic resin, (e) a second set of corresponding structural-foam shanks formed in mold cavitities of partially-foamed synthetic resin, said shanks in said second set being longer than those in said first set, said shanks in said first and second sets having openings therein adapted to receive snugly but without interference said balance pins and guide pins, said shanks being adapted to be lifted off of said pins without releasing any connector elements, (f) felt cushion means mounted around said pins beneath said shanks, (g) black key caps mounted on the outer ends of the shanks in said first set thereof, and (h) white key caps mounted at the outer ends of the shanks in said second set thereof, said white key caps being hollow and having means therein to permit mounting in precise relationship over said shanks, said white key caps being different shapes whereby to fit around said black key caps.

22. The invention as claimed in claim 21, in which a portion of a piano action is mounted above the inner end portion of each of said shanks for operation thereby.

* * * * *

UNITED STATES PATENT AND TRADEMARK OFFICE

CERTIFICATE OF CORRECTION

PATENT NO. : 4,205,583

DATED : June 3, 1980

INVENTOR(S) : Horst L. Absmann

It is certified that error appears in the above-identified patent and that said Letters Patent are hereby corrected as shown below:

In Col. 10, line 57 delete "formed" and insert --foamed--.

Signed and Sealed this

*Tenth* Day of *November 1981*

[SEAL]

*Attest:*

GERALD J. MOSSINGHOFF

*Attesting Officer*

*Commissioner of Patents and Trademarks*